United States Patent [19]

Colleselli

[11] 4,381,925

[45] May 3, 1983

[54] GRINDING DISK

[75] Inventor: Karl Colleselli, Schwaz, Austria

[73] Assignee: Tyrolit-Schleifmittelwerke Swarovski KG, Schwaz, Austria

[21] Appl. No.: 229,673

[22] Filed: Jan. 29, 1981

[30] Foreign Application Priority Data

Apr. 1, 1980 [AT] Austria ..... 1754/80

[51] Int. Cl.[3] ..... B24D 3/34

[52] U.S. Cl. ..... 51/298; 51/307; 51/308; 51/309

[58] Field of Search ..... 51/307, 298, 309, 308

[56] References Cited

U.S. PATENT DOCUMENTS 3,592,618 7/1971 Alden ..... 51/298

3,874,856 4/1975 Leeds ..... 51/298

4,021,208 5/1977 Oberbichler ..... 51/307

*Primary Examiner*—James H. Derrington

*Attorney, Agent, or Firm*—Wenderoth, Lind & Ponack

[57] ABSTRACT

A grinding disk comprising abrasive grains such as corundum, a bonding agent such as phenolic resin, and a filler material.

At least part of said filler material is an active filler, i.e. a material that acts chemically and/or physically in the grinding process.

At least part of this active filler material is provided in the form of particles that are solid bodies of lamellar structure. The lamellar structure is a supporting grid and has an intercalated guest component.

15 Claims, No Drawings

GRINDING DISK

The present invention relates to an abrasive article comprising abrasive grains, e.g. corundum, an organic bonding agent, e.g. phenolic resin, or an inorganic, coldsetting bonding agent, e.g. phosphate bond, and an active filler.

It is already known that fillers are used in abrasive articles. In the abrasive industry, the term filler applies to the three following groups:

1. Fillers in the classic, usual sense, used for filling plastic materials.

These fillers have the following effects:

(a) Decreased necessity for resin, consequently lower costs of the resin system and, hence, of the abrasive article.

(b) Reinforcing effects and, consequently, increased stability of the bond between the abrasive grains. This effects an increase in the "bursting speed", abrasive hardness, lateral stability etc. of the abrasive article.

(c) Decrease in the bond stability, in such a way obtaining a smoother abrasion. Blunt abrasive grains break out more easily so that the self-sharpening properties of the abrasive articles are improved, however, the wear of the abrasive disks is increased.

With some fillers two effects, (a) and (b), or (a) and (c), occur at the same time.

Examples of such fillers which have been used are: wood powder, coconut shell flour, stone dust, feldspar, kaolin, quartz, short glass fibers, asbestos fibers, ballotini, surface-treated fine grain (silicon carbide, corundum etc.), pumice stone, cork powder etc.

It is a common feature of these fillers that they are "inactive", i.e. they do not undergo any chemical reaction or physical change during the abrasive process and therefore do not create any positive effect on the grinding process.

2. Fillers influencing the making of the grinding disks, particularly the thermal curing of the synthetic resins, e.g. magnesium oxide, and calcium oxide.

3. "Active fillers". They undergo chemical reaction or physical change during the abrasive operation, which have a positive influence on the behaviour of the abrasive. These fillers should particularly cause an increase in the service-life of the abrasive tool and a decrease in the heating of the workpiece and the abrasive article and, hence, avoid thermal destruction. These fillers are the prerequiste for an economic processing, when materials that are hard to chip, such as unalloyed low carbon steels or titanium, are to be worked.

Active fillers can also obviously produce the same effects as the fillers indicated under (1) and (2) (increase or decrease in stability, influence on the curing process, etc).

In addition to the fillers, additives improving the adhesiveness between the abrasive grain and the bonding agent, (e.g. coatings with silanes, or e.g. frits with fused metal oxides, ceramic coatings, etc.) may also be employed.

Other additives facilitate processing, for example, by either improving the noncaking free flowing qualities of the abrasive mix or reducing the internal friction in the pressing process. It is not necessary that these additives are active in the actual abrasive process.

The active fillers are the most important fillers in mixes for abrasive disks. Their effects can generally be divided into the three following main groups:

1. Decrease in the friction between abrasive grain and the workpiece, and between the abrasive grain and chips, i.e. the fillers and their by-products, must have the effect of high temperature lubricants or high pressure lubricants. They can thereby form a film or melted mass (e.g. cryolite) or a solid lubricating film (graphite, molybdenum sulfide).

2. Protective effect by forming a surface film on the abrasive grain, workpiece and chips. Grain destruction due to diffusion processes (e.g. spinel formation when grinding iron material containing corundum), the welding of the grit to the grain or to the workpiece, and the formation of built-up edges (covering of the grain with grit) are avoided.

3. Cooling effect in a location between the chips and abrasive grain, due to high melting or vaporization heat in an advantageous temperature range. That is, an endothermic reaction of the filler material takes place.

Particularly active fillers are, for example, halogenides (e.g. lead chloride, fluorspar, cryolite etc.), chalcogenides (e.g. pyrite, antimony sulfide, zinc sulfide, molybdenum sulfide, selenides, tellurides etc.), low melting metals (e.g. lead, tin, low melting composition metals,) high pressure lubricants (e.g. graphite).

Numerous substances can, however, not or only under certain circumstances be practically employed as they are expensive (noble metal halogenides, molybdenum sulfide), toxic (arsenic-, selenium-, lead compounds) or hygroscopic and of high water solubility (numerous chlorides). They further strongly react with the uncured phenolic resin system (e.g. hygroscopic acidic chlorides) used as bonding agent or reduce the disk stability (e.g. graphite sulfur).

It is the object of the present invention to provide an abrasive article in which the filler is adapted to fulfil various requirements.

According to the present invention this is achieved by using, as at least part of the filler particles, active filler particles which are bodies of lamellar structure, said lamellar structure serving as a supporting grid for an intercalated guest component present therein. Due to the present invention, the filler particles are highly active, and they will have the effects of high pressure- and high temperature lubricants during the use of the abrasive article in a grinding operation.

Preferably at least 3% of the active filler based on the total weight of the active filler is solid bodies of a lamellar structure, acting as a supporting grid, having an intercalated guest component.

Good results have been obtained with an abrasive article wherein 20% to 50% of the active filler, based on the total weight of the active filler is solid bodies of a lamellar structure, acting as a supporting grid, having an intercalated guest component.

Preferably, the guest component is either a metal, a metal halide or a metal sulfide.

Intercalation substances are elements or compounds in which other atoms, ions or molecules are intercalated as a "guest component" into a grid of the element or compound whereby the relation between the atoms of the "host grid" and the atoms, ions or molecules of the guest component is usually nonstoichiometric. Examples of the guest component therefore are the metallic hydrides, carbides and nitrides of Ti,V,Mo, W and other transition metals.

The intercalation compounds, with an alkali metal as guest component, have first been found in graphite as the host grid.

The stepwise intercalation is characteristic of the polar graphite compounds: the guest component can enter into each base parallel layer gap of the graphite grid (1. step), it can, however, also only occupy every second, third, fourth etc. gap (2.,3.,4., etc step). The regular intercalation is due to the ionogenic character of the compounds as the positively or negatively charged layers will endeavour to be spaced over the grid as reqularly as possible. It is a common feature of these compounds that they change into graphite again during thermal decomposition.

Metal chloride-graphite intercalation compounds also belong to the compounds of polar character. An increasing number of them has been prepared during the last 20 years only. (See Materials Science and Engineering, 31 (1977) 53–59, Elsevier Sequoia S.A. Lausanne; Gh. Henning, Progress inorg. Chem. I 125 (1959).

Preferably in the present invention at least part of the filler particles are a graphite-ferrous chloride ($FeCl_2$) intercalation compound or a graphite-ferric chloride ($FeCl_3$) intercalation compound.

Some of these materials, e.g. metal chlorides, such as ferric chloride ($FeCl_3$), zinc chloride, tin chloride, potassium chloride as well as elemental sulfur, are highly active and can favourably be employed in view of their low toxicity (high TLV) and low costs. (TLV=threshold limit values).

One embodiment of the present invention provides that the filler particles are provided with a protective coating, (against solvents or humidity or abrasion wear or a coating that improves the adhesion to the bonding agent of the grinding wheel).

The coating can be cured synthetic epoxy resin, mixed with very fine (1000 mesh) corundum powder, compatible with the bonding agent. This coating would provide protection and improvement of adhesion.

A further embodiment provides that the coating is inorganic, e.g. consisting of silicates or phosphates. This would also provide protection and improvement of adhesion.

It is further preferably provided that fine grained, hard matters, e.g. silicon carbide, corundum, silicate, are admixed with the coating in order to increase adhesiveness.

It has been found that the combination of graphite with other fillers, e.g. calcium hydroxide, which separate water at relatively low temperatures (up to about 400° C.) produce especially favourable abrasive properties in the abrasive articles, particularly a cool abrasive behaviour.

A further embodiment of the present invention provides that the diameter or equivalent, spherical diameter of the filler particles is almost equal to the average, spherical diameter of the abrasive grains.

The abrasive article is manufactured in a conventional manner. The abrasive grains and the coarse filler particles are, for example, wetted with a liquid phenolic resol. Then a mixture of pulverulent bonding agent, for example a Novolak resin, and the remainder of the fillers, is added so that the abrasive grains and the coarse filler particles are coated with the resin and the fine fillers. The resultant mixture is pressed into forms and cured in furnaces at a temperature of about 180° C.

Other production methods can obviously also be applied, e.g. methods suitable for hot-pressed, resinoid-bonded abrasive articles.

EMBODIMENT

| Recipe: | |
|---|---|
| Regular corundum 24 mesh | % by weight 70 |
| Phenolic resol (SWC F14) | % by weight 4 |
| Novolak resin (SWC 101) | % by weight 8 |
| Filler particles of a graphite-ferric chloride intercalation compound | % by weight 18 |

Density after pressing 2.50 gr per ccm.
SWC stands for Süd-West Chemie, Neu Ulm (Fed. Rep. of Germany)

The abrasive grain, is mixed with the solvent in order to wet the abrasive grain. The wetted grains are then mixed with the liquid phenolic resin so that the liquid resin coats the abrasive grains. The powdered phenolic resin and finely divided filler are separately blended in a mixer to form an intimate mixture thereof and the wetted abrasive is then added to and mixed with the blended powders to uniformly coat each particle of abrasive with the blended powdered materials. The resulting mixture is then loaded into a suitable mold and cold pressed at about 3000 p.s.i. to form a wheel 16 inches in diameter $\times \frac{1}{8}$ inch thick with a 1 inch diameter central hole. The wheel thus formed is removed from the mold and cured at a temperature of about 180° C. for a period of about 36 hours.

What is claimed is:

1. In an abrasive article comprising abrasive grains, a bonding agent, and an active filler, the improvement wherein at least a part of the active filler is graphite of a lamellar structure, acting as a supporting grid, having an intercalated guest component selected from the group consisting of a metal, a metal halide, a metal sulfide, a transition metal hydride, a transition metal carbide, a transition metal nitride and elemental sulfur.

2. An abrasive article according to claim 1, wherein at least 3% of the active filler based on the total weight of the active filler is graphite of a lamellar structure, acting as a supporting grid, having said intercalated guest component.

3. An abrasive article according to claim 2, wherein 20% to 50% of the active filler based on the total weight of the active filler is graphite of a lamellar structure, acting as a supporting grid, having said intercalated guest component.

4. An abrasive article according to claim 1, wherein said guest component is a metal, a metal halide or a metal sulfide.

5. An abrasive article according to claim 3 wherein said filler particles are a graphite-ferrous, chloride intercalation compound.

6. An abrasive article according to claim 4, wherein said filler particles are a graphite-ferric chloride intercalation compound.

7. An abrasive article according to claim 1, 2, 3, 4, 5 or 6, wherein said filler particles are provided with a coating.

8. An abrasive article according to claim 7, wherein said coating is a cured synthetic resin compatible with said bonding agent.

9. An abrasive article according to claim 7, wherein said coating is inorganic.

10. An abrasive article according to claim 8, wherein fine grained, hard matters are admixed with said coating to increase adhesiveness.

11. An abrasive article according to claim 1, wherein the guest component is a member selected from the group consisting of the hydrides, carbides and nitrides of titanium, vanadium, molybdenum and tungsten, an alkali metal, ferric chloride, ferrous chloride, zinc chloride, tin chloride, potassium chloride and elemental sulfur.

12. An abrasive article according to claim 9, wherein said coating is a silicate or a phosphate.

13. An abrasive article according to claim 10, wherein said fine grained, hard matters are silicon carbide, corundum or a silicate.

14. An abrasive article according to claim 9, wherein fine grained, hard matters are admixed with said coating to increase adhesiveness.

15. An abrasive article according to claim 14, wherein said fine grained, hard matters are silicon carbide, corundum or a silicate.

* * * * *